US007040034B2

(12) United States Patent
Nielson et al.

(10) Patent No.: US 7,040,034 B2
(45) Date of Patent: May 9, 2006

(54) MULTI-PURPOSE MARKING DEVICE

(75) Inventors: Douglas R. Nielson, Logan, UT (US); Silviano Sanchez, II, Logan, UT (US); Bobby Harris, Richmond, UT (US); Kurt A. Robinson, Providence, UT (US)

(73) Assignee: BDK Enterprises, Inc., Logan, UT (US)

( * ) Notice: Subject to any disclaimer, the term of this patent is extended or adjusted under 35 U.S.C. 154(b) by 0 days.

(21) Appl. No.: 10/873,058

(22) Filed: Jun. 21, 2004

(65) Prior Publication Data

US 2004/0255482 A1 Dec. 23, 2004

Related U.S. Application Data

(60) Provisional application No. 60/480,078, filed on Jun. 19, 2003.

(51) Int. Cl.
*B25H 7/04* (2006.01)

(52) U.S. Cl. ..... 33/666; 33/669; 33/613; 33/574

(58) Field of Classification Search ..... 33/666, 33/613, 645, 677, 518, 562, 574, 578, 579, 33/546, 669–679, 577, 573, 516; 7/138
See application file for complete search history.

(56) References Cited

U.S. PATENT DOCUMENTS

| | | | | |
|---|---|---|---|---|
| 763,745 | A * | 6/1904 | Gheen | 7/138 |
| 808,704 | A | 1/1906 | Van Meter | |
| 877,879 | A * | 1/1908 | Ash | 33/669 |
| 912,052 | A | 2/1909 | Albertson | |
| 1,624,508 | A * | 4/1927 | Reilly | 81/125.1 |
| 3,406,460 | A | 10/1968 | Colwell | 33/189 |
| 4,363,173 | A | 12/1982 | Caldera | 33/666 |
| 4,389,790 | A | 6/1983 | Dunlap | 408/241 G |
| 4,520,571 | A | 6/1985 | Harding | 33/666 |
| 4,527,337 | A * | 7/1985 | Dreiling | 33/562 |
| 4,993,168 | A | 2/1991 | Acuna | 33/666 |
| 5,068,976 | A | 12/1991 | Bell | 33/666 |
| 5,129,154 | A | 7/1992 | Aydelott | 33/613 |
| D351,542 | S * | 10/1994 | Smith | D8/28 |
| 5,375,339 | A | 12/1994 | Noel, Jr. | 33/518 |
| D376,094 | S | 12/1996 | Hubbard | D8/354 |
| 5,937,613 | A | 8/1999 | Vess, Sr. | 52/749.1 |
| 6,055,736 | A | 5/2000 | Gaston | 33/528 |
| 6,077,000 | A | 6/2000 | Gibbons et al. | 408/72 B |
| 6,508,011 | B1 * | 1/2003 | Lee | 33/666 |
| 6,907,675 | B1 * | 6/2005 | Hutchings | 33/666 |

* cited by examiner

*Primary Examiner*—G. Bradley Bennett
(74) *Attorney, Agent, or Firm*—Kunzler & Associates

(57) ABSTRACT

A device and method are provided for marking bolt holes in sill boards. The marking device includes a rectangular, substantially planar member having a first end and a second end. One or both ends are configured to receive an anchor bolt. A first punch is positioned a first distance between the ends of the marking device such that the punch is aligned with each end of the marking device. The punch is preferably connected to the planar member by a securing member such that the punch is perpendicular to a face of the planar member. The punch is preferably adjustable. Optionally, a second punch is connected to the planar member. One or both ends may include a tortured slot to receive anchor bolts having a number of diameters.

16 Claims, 7 Drawing Sheets

MULTI-PURPOSE MARKING DEVICE

CROSS-REFERENCES TO RELATED APPLICATIONS

This application claims benefit of U.S. Provisional Patent Application No. 60/480,078 entitled "Multipurpose Bolt Hole Marker" and filed on Jun. 19, 2003 for Doug Nielson, Silviano Sanchez, Bobby Harris, and Kurt Robinson, which is incorporated herein by reference.

BACKGROUND OF THE INVENTION

1. Field of the Invention

The invention relates to tools, more specifically, the invention relates to a multipurpose tool for marking bolt holes as well as performing various other tasks required in general construction.

2. Description of the Related Art

Conventional construction is constantly being improved to reduce the amount of manual labor required. Less manual labor helps keep costs for the construction down. Conventional stick framing of buildings, however, still involves a considerable amount of manual labor.

FIG. 1 illustrates a conventional manual task that requires considerable time and skill to properly complete. The task involves preparing a sill board 10 to be mounted to a foundation 12, such as a wall, by anchor bolts 14 that protrude from the cement surface. The anchor bolts 14 secure the sill board 10 to the foundation 12.

Generally, anchor bolts 14 are placed within the cement before the cement fully sets. The anchor bolts 14 are spaced longitudinally along the foundation according to building specifications. A threaded portion of the anchor bolt 14 extends substantially perpendicular from the foundation surface. The threaded portion passes through a pre-drilled sill board 10 and nuts (not illustrated) are tightened down on each anchor bolt 14.

Unfortunately, the anchor bolts 14 are not always longitudinally aligned within the cement. The worker placing the anchor bolts 14 may place low significance on aligning the anchor bolts 14. Alternatively, the setting cement may cause the anchor bolts 14 to shift out of alignment.

Bolt holes corresponding to the location of each anchor bolt 14 must be drilled in the sill board 10. In addition, the sill board 10 must follow a straight line 11 along the surface of the foundation 12. Consequently, the sill board 10 must be marked and drilled to receive the anchor bolts 14 that are not longitudinally aligned.

Framing for walls of a structure are secured to the sill boards 10. In addition, sill boards 10 may be used to guide brick laying. Sill boards 10 are wooden boards cut to an appropriate length. The sill boards 10 may be higher quality wood treated to resist rotting. Generally, two different size sill boards 10 are used, two by four (2×4) or two by six (2×6). Walls that use a 2×6 sill board 10 generally carry a higher load than walls that use a 2×4 sill board 10.

Conventionally, a skilled worker marks the sill board 10 using a time consuming process. Each anchor bolt must be centered in the drilled hole. One or more holes that are not centered can cause pre-drilled holes further along the length of the sill board 10 to be completely misaligned with a corresponding anchor bolt 14.

Many conventional methods exist for marking the holes for the anchor bolts 14. The sill board 10 includes a front edge 16 and a back edge 18. In one method, a worker aligns the front edge 16 with a chalk line that indicates the straight line 11 on the surface of the foundation 12 that the sill board 10 is intended to follow once installed. Next, the worker makes two parallel lines perpendicular to the sill board 10. The parallel lines indicate the location of the anchor bolt 14 longitudinally with respect to the sill board 10 and the diameter of the anchor bolt 14. The worker then uses a measuring tape to take a measurement from the side of the anchor bolt 14 facing the sill board 10 to the front edge 16. The worker then measures from the back edge 18 between the two parallel lines and makes a mark according to the measurement just taken. Typically, the mark is an "X" positioned according to the measurement and halfway between the two parallel lines so as to coincide with the center of the anchor bolt 14.

Conventional marking methods have numerous problems. Conventional marking methods include a number of time-consuming steps that must be accurately repeated for each anchor bolt 14. A standard sill board 10 may have 8–25 or more anchor bolts 14. Conventional methods involve a number of tools such as a pencil, a straight edge or square, and a measuring tape. A worker may make a mistake performing any of the conventional steps. Even a small mistake can cause marked bolt holes further along the sill board 10 to be incorrect.

Once a sill board 10 is marked, the worker drills the marked bolt holes and places the sill board 10 on the foundation 14 over the anchor bolts 14. The sill board 10 is secured to the anchor bolts 14 using nuts (not illustrated). The worker uses a wrench to tighten the nuts. The wrench may be a ratchet, box end, open end, or similar type wrench. Typically, anchor bolts 14 and the corresponding nuts for different sill boards 10 are of two different sizes. The same structure often includes sill boards 10 requiring each size. Generally, the nuts are either ¾-inch size or 15/16-inch size. Consequently, the worker may carry two wrenches or two sockets of the appropriate size.

Generally, one or two workers are responsible for marking and mounting all of the sill boards 10 on a construction site so that framing of the structure can begin. Using conventional methods, the workers must carry, or have readily accessible, multiple different hand tools including a marking instrument such as a pencil, a measuring instrument such as a tape measure, a straight edge or square, a chalk line, a drill, and two different wrenches.

Furthermore, additional tools may be required for removal of a mounted sill board 10. Once the nuts are removed from the anchor bolts 14, removing the sill board 10 may be difficult because the sill board 10 may be warped. Consequently, the worker may carry a tool to assist in prying the sill board 10 up off of the foundation surface. It can be difficult for a worker to carry and keep track of all these tools.

Accordingly, what is needed is a device that overcomes the problems and disadvantages of the prior art. In particular, the device should mark bolt holes corresponding to the anchor bolts 14 regardless of the longitudinal alignment of the anchor bolts 14. The device should mark the precise center of the bolt hole corresponding to the center of the anchor bolt 14. The device should mark a bolt hole such that a guide hole is formed in the sill board 10 to assist in drilling the bolt hole. In addition, the device should readily identify anchor bolts 14 that are positioned such that the anchor bolt 14 is unusable. The device should minimize the number of separate tools required to mount or remove sill boards 10 of different sizes and anchor bolts of different sizes.

The device must save the worker time. Consequently, the device should be simple. The device should not require frequent adjustment and preferably has minimal moving parts. In addition, the device should be of minimal size and substantially flat to facilitate use and storage of the device. The device must also be easy to transport. A bulky or odd shaped device prevents easy storage in a pocket, tool belt or toolbox. The device should not encumber the worker's movement when stored in the worker's pocket or tool belt. The device should be readily available to the worker. Furthermore, the device should be lightweight, sturdy, durable, simple, and inexpensive. The present invention provides these advancements in a novel and useful way.

SUMMARY OF THE INVENTION

The present invention has been developed in response to the present state of the art, and in particular, in response to the problems and needs in the art that have not yet been met for marking bolt holes. Accordingly, the present invention has been developed to provide an apparatus, system, and method for marking bolt holes that overcomes many or all of the above-discussed shortcomings in the art.

A marking device for marking bolt holes in sill boards according to the present invention includes a substantially planar member having a first end and a second end. The ends are configured to receive an anchor bolt. A first punch is positioned a first distance between the ends of the planar member such that the punch is aligned with each end of the planar member. A second punch may be positioned a second distance between the ends of the planar member such that the second punch is aligned with each end of the planar member.

The marking device punch extends perpendicular to a face of the planar member. The position of the punch is fixed relative to the planar member. The punch is connected to the planar member by a securing member. The securing member is configured such that the punch may be adjusted with respect to the planar member.

In one embodiment, each end of the marking device comprises a tortured slot. The tortured slots allow the marking device to receive anchor bolts having a plurality of diameters. In another embodiment of the marking device, the ends are configured to engage an anchor nut and serve as a wrench head for adjusting the anchor nut relative to the anchor bolt. Another embodiment of the marking device has a tool, such as a wrench head, straight edge, or ruler, integrated with the planar member of the marking device.

Another embodiment of the marking device has a single end configured to receive an anchor bolt. In this embodiment a first punch is positioned a first distance from the end such that the punch is aligned with the end of the marking device.

A method of marking anchor bolt holes on a sill board is described. The worker places a sill board on a foundation a predetermined offset from an edge of the foundation. The worker engages the anchor bolt with the marking device such that the marking device is perpendicular to the sill board. Next, the worker impacts a surface of the marking device such that the punch marks the sill board.

Preferably the worker then drills holes in the sill board in locations marked by the punch. The worker then places the sill board over the anchor bolts and installs anchor nuts on the anchor bolts. Using the marking device the work then tightens the anchor nuts using the wrench head of the end of the planar member.

The features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

The present invention solves the foregoing problems and disadvantages with a sturdy multipurpose device for marking bolt holes and performing other tasks related to mounting and removing sill boards from anchor bolts.

Figure 1:
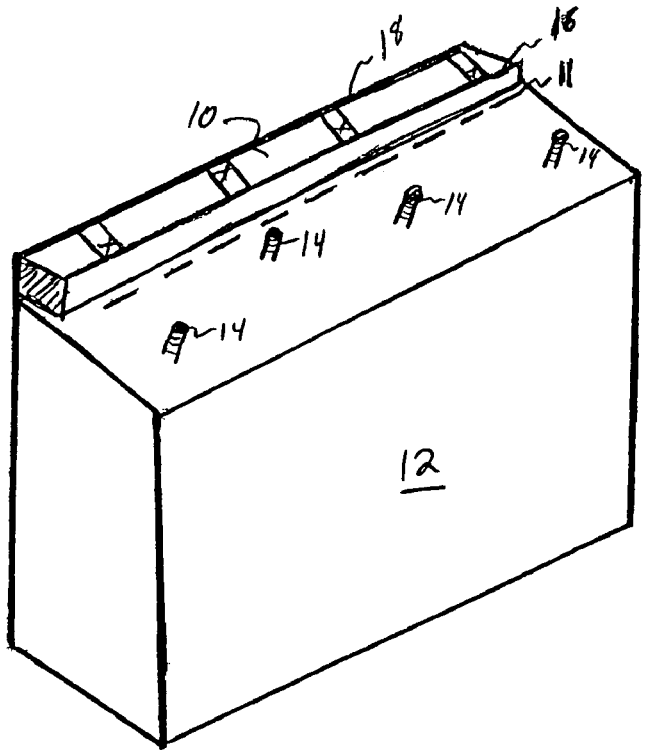
FIG. 1 Prior Art
FIG. 1 is a perspective view of a sill board marked for drilling of holes to receive anchor bolts.
Figure 2:
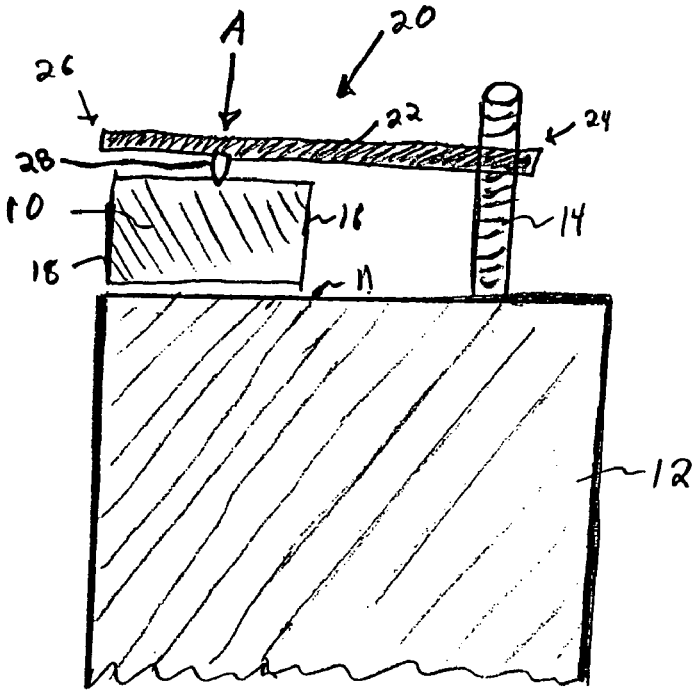
FIG. 2 is an end view of one embodiment of a marking device in accordance with the present invention.

Referring now to FIG. 2, in one embodiment, a marking device 20 for marking bolt holes is illustrated. The device 20 includes a rigid, substantially planar member 22 having a first end 24 and a second end 26. Preferably, the ends 24, 26 are configured to receive an anchor bolt 14. The device also includes a punch 28. The punch 28 is positioned a predetermined distance from the first end 24. Preferably, the punch 28 is pointed such that the punch forms a bolt hole mark suitable to guide a drill bit of a drill. The punch 28 may be sharp or blunt.

To use the marking device 20, a worker marks a straight line 11, preferably with a chalk line, and positions a sill board 10 along the line 11 as described above. Next, the worker engages the anchor bolt 14 using the first end 24 and places the length of the marking device 20 perpendicular to the sill board 10. The punch 28 is positioned over the surface of the sill board 10 indicating the center point of the anchor bolt 14. The predetermined distance of the punch 28 from the first end 24 allows the device to translate the position of the anchor bolt 14 relative to the line 11 to a corresponding position for the anchor bolt 14 in the sill board 10.

Next, the worker applies pressure, either by hand or with a tool such as a hammer, to the surface of the planar member 22 near the punch 28 (indicated by arrow A) to form a bolt hole mark in the sill board 10. The worker repeats this process to quickly mark all the bolt holes along the length of the sill board 10. Once all the holes are marked, a worker drills the holes and places the sill board 10 on the foundation surface over the anchor bolts 14.

Using the device 20, a worker may quickly mark a plurality of bolt holes. The bolt holes are accurate and provide a guide to assist in drilling the bolt holes. The worker does not need a measuring device, a marking device, or a straight edge to quickly and accurately mark all the bolt holes.

Figure 3:
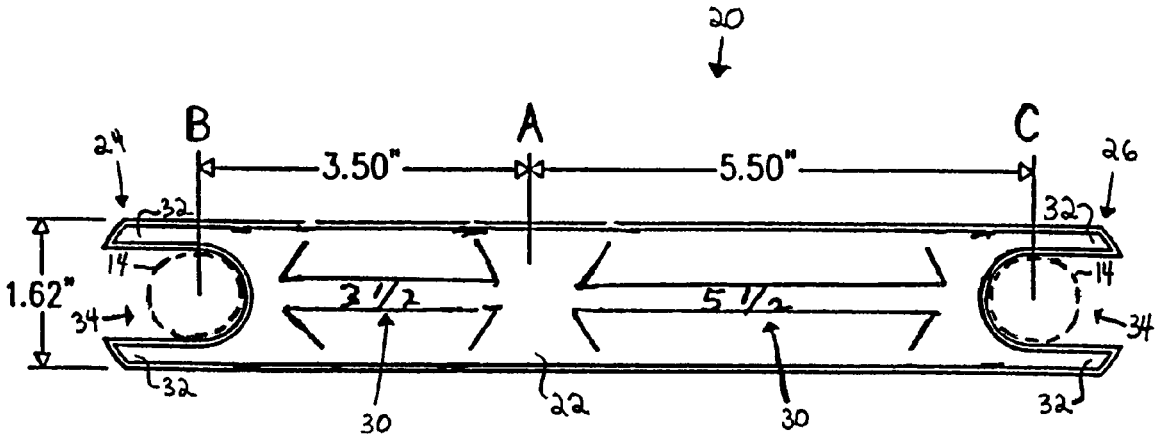
FIG. 3 is a plan view illustrating one embodiment of a marking device in accordance with the present invention.

Referring now to FIG. 3, a plan view of the device 20 is illustrated. Preferably, the device 20 is rectangular having a minimal width and length. Alternatively, the device 20 may be other suitable shapes and sizes.

As mentioned above, the device 20 accurately determines the proper location for the anchor bolt 14 in a sill board 10 due to the alignment of the punch 28 (See FIG. 2) in relation to the ends 24, 26. Preferably, the punch 28 is positioned (designated by line A) about three and one-half inches from the center (designated by line B) of an anchor bolt 14 (in phantom) positioned in the first end 24 and five and one-half inches from the center (designated by line C) of an anchor bolt 14 (in phantom) positioned in the second end 26. The punch 28 extends from the backside of the planar member 22 and is horizontally aligned with the center of an anchor bolt 14 received at the first end 24 and second end 26.

Referring to FIG. 3 and generally to FIG. 2, the distance between the punch 28 and the center of an anchor bolt 14, for example A to B, is predetermined. Preferably, the distance between A and B is about one-half inch shorter than the width of the sill board 10 to be marked using an end 24, 26 of the device 20. This means that the anchor bolt 14 must be no further than the width of the sill board 10 minus one inch from the straight line 11. This ensures that the anchor bolt 14 will be within one-half inch of the edges 16, 18 when the sill board 10 is installed. Of course, the difference of one-half inch shorter than the width of the sill board 10 may be changed in other embodiments according to allowed tolerances for placement of anchor bolts 14 in sill boards 10.

Furthermore, the precise distance between the punch 28 and the center for an engaged anchor bolt 14 allows the device 20 to readily indicate when an anchor bolt 14 is positioned outside acceptable limits relative to the line 11. For example, if the bolt 14 is too close to the line 11, the punch 28 will be positioned beyond the back edge 18. Similarly, if the bolt 14 is too far away from the line 11, the punch 28 will be between the front edge 16 and the bolt 14. In this manner, unacceptably positioned anchor bolts 14 are readily identifiable using the device 20.

Referring back to FIG. 3, preferably, the punch 28 is positioned such that the device 20 may be used with two of the most common sill board sizes, 2×4 inches and 2×6 inches. If a 2×4 sill board 10 is being marked, the first end 24 engages the anchor bolt 14. Similarly, if a 2×6 sill board 10 is being marked, the second end 26 engages the anchor bolt 14. Consequently, the length of the marking device 20 is chosen so the distance between A and B is about three and one-half inches, and the distance between A and C is about five and one-half inches. The length of the marking device 20 may be optimally chosen so the worker uses a single punch 28 for both 2×4 and 2×6 sill boards 10.

Preferably, the surface of the device 20 includes markings 30 that indicate to a user the distances, respectively, between A–B and A–C. The markings 30 may be painted, silk screened, pad printed, or etched onto the surface of the device 20. In one embodiment, the markings 30 simply indicate the size of the sill board 10 that end 24,26 of the device 20 is designed to be used with.

The ends 24, 26 are configured to readily receive an anchor bolt 14. The ends 24, 26 comprise arms 32 that extend in the same plane as the planar member 22 to form a opening 34 for receiving an anchor bolt 14. Preferably, the opening is substantially "U" shaped. In one embodiment, the base of the "U" may be "V" shaped to form a hex-shaped opening for engaging a hex-shaped nut. Alternatively, the arms 32 may come together to form a void (not illustrated) sized to receive an anchor bolt 14. A "U" shaped opening 34 allows the worker to engage anchor bolts 14 more quickly than an "O" shaped void; however, both embodiments and similar variations are considered within the scope of the present invention.

The opening 34 is sized and shaped such that when the opening 34 engages an anchor bolt 14 the radius of the anchor bolt 14 positions the center of the anchor bolt 14 at location B or location C, as illustrated. Typically, anchor bolts 14 for the first end 24 have a different radius than anchor bolts 14 for the second end 26. Accordingly, location B and location C extend different distances into the corresponding opening 34. In addition, the diameter of the opening 34 is sized to accommodate a corresponding anchor bolt 14.

Figure 4:
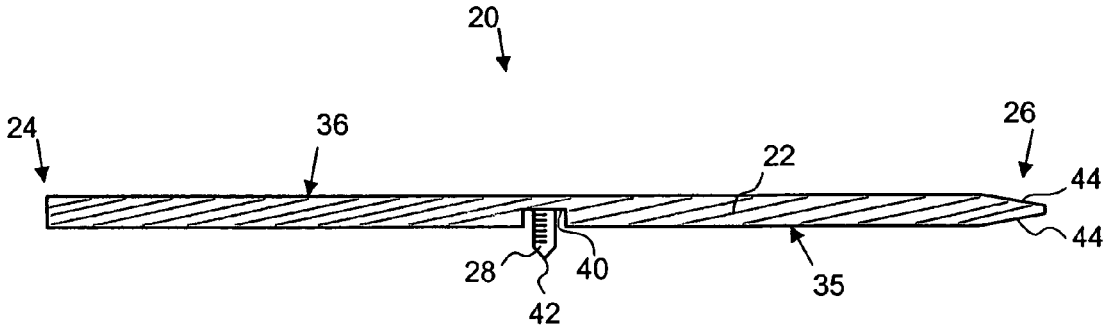
FIG. 4 is a cross-section view of one embodiment of a marking device in accordance with the present invention.

FIG. 4 illustrates a cross-section side view of one embodiment of the present invention. The planar member 22 is a durable rigid member that includes a top surface 36 and a bottom surface 35. Preferably, the top surface 36 and bottom surface 35 are substantially flat. Alternatively, the top surface 36 and/or bottom surface 35 may include ergonomic features such as raised portions (not illustrated), a rubber skin (not illustrated), or the like to facilitate use of the device 20 by workers.

In one embodiment, the planar member 22 includes a securing member 40 configured to receive the punch 28. Preferably, the securing member 40 comprises a void that extends completely through the planar member 22. Alternatively, the void may extend to about half the thickness of the planar member 22. The securing member 40 serves to secure the punch 28 during operation of the device 20. The punch 28 does not move relative to the planar member 22 while marking bolt holes. The marking device 20 minimizes tool maintenance, such as lubrication, since the device has minimal moving parts.

It is contemplated that the securing member 40 may secure the punch 28 using a variety of mechanical or chemical techniques. The securing member 40 may comprise various types of mechanical fasteners for engaging the punch 28. For example, in a preferred embodiment, the securing member 40 and punch 28 include threads such that the punch 28 may be threaded into the securing member 40.

Accordingly, the punch 28 may include a polygonal cross-section to allow the punch 28 to be readily tightened or removed from the securing member 40. Alternatively, the securing member 40 may comprise glue or a weld between the punch 28 and the bottom surface 35. Those of skill in the art will readily recognize a variety of fastening techniques for connecting the punch 28 to a securing member 40. Each of these fastening techniques are considered within the scope of the present invention. Examples of certain embodiments are provided herein for illustration purposes.

The securing member 40 is preferably configured such that the worker may adjust the punch 28 vertically with respect to the planar member 22. For example, the securing member 40 may comprise a cylindrical opening having threaded walls as discussed above. A worker may rotate the punch 28 to adjust the vertical distance that the punch 28 extends from the bottom surface 35 of the marking device 20. Furthermore, the worker may rotate the threaded punch 28 until it is no longer attached to the securing member 40. If the worker removes the threaded punch 28, the worker may then thread a replacement punch 28 into the securing member 40. In this manner, the worker may replace worn or broken punches 28.

The punch 28 is preferably a straight rigid member that forms indentations in a sill board 10. The punch 28 extends from the bottom surface 35 for a distance sufficient to form an indentation to mark a bolt hole. Preferably, the punch 28 is short and stubby such that the punch 28 resists bending. The punch 28 is designed to be used for a long period of time without bending, breaking, or otherwise becoming inoperable.

The punch 28 includes a pointed end 42. The pointed end 42 is sharpened to allow for long-term use marking bolt holes. Preferably, the pointed end 42 is coaxial with the center of the punch 28. In certain embodiments, the pointed end 42 may be blunt to prevent injury to workers, but still be effective in marking bolt holes.

While the planar member 22 and punch 28 may be formed from various materials, in a preferred embodiment, the planar member 22 and punch 28 are formed from metal, such as stainless steel or titanium, so that the device 20 is durable and long lasting. Alternatively, the planar member 22 and punch 28 may be made from plastic, ceramic, man-made composites, or the like.

Preferably, the planar member 22 has a constant thickness along its length. The thickness is such that the device 20 is durable and has a long, useful life, but is of minimal length, width, and weight to allow for convenient use. Alternatively, one or both ends 24, 26 of the planar member 22 may be tapered to allow the device 20 to serve as a pry bar.

For example in FIG. 4, the second end 26 is tapered and includes a pair of inclines 44. Of course, the slope of the inclines 44 may vary between embodiments of the present invention. The tapered second end 26 may be inserted between a sill board 10 and the foundation 12. The planar member 22 may be used as a lever to lift the sill board 10 off of anchor bolts 14.

Figure 5:
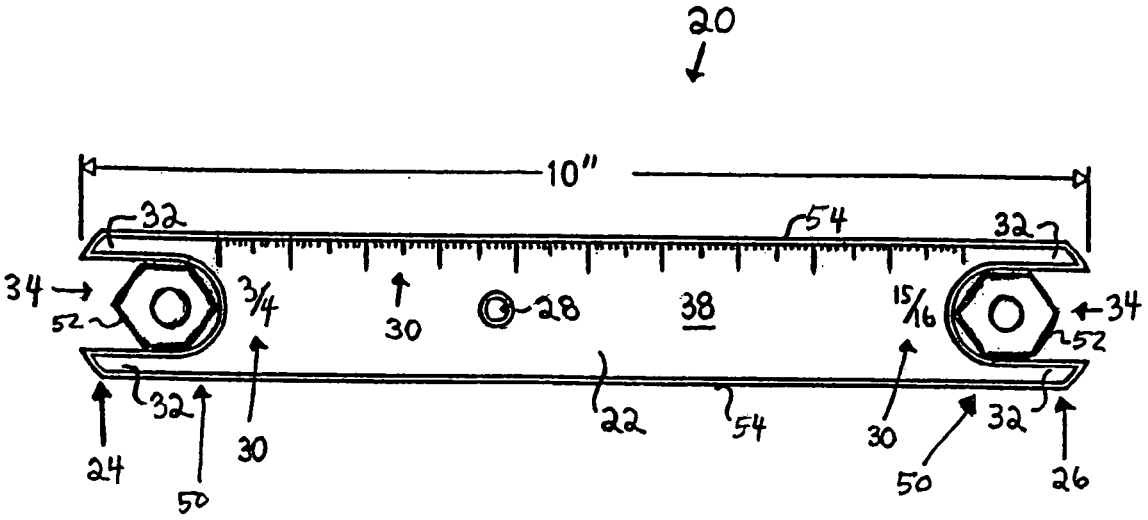
FIG. 5 is bottom view of one embodiment of a marking device in accordance with the present invention.

The present invention is a multipurpose bolt hole marker. In addition to serving as a bolt hole marker, the present invention functions in place of several tools a worker typically uses to install and remove sill boards 10. As in the example described above, the worker may use the device 20 as a pry-bar. Referring now to FIG. 5, a bottom view of one embodiment illustrates additional tools that may be integrated with the device 20.

Preferably, the planar member 22 is substantially rectangular having two straight parallel sides 54. In certain embodiments, the top surface 36 (see FIG. 4) is flat. Consequently, the top surface 36 may be laid flat against a board or other material. The worker may use the straight sides 54 as a straight edge for marking a line for another construction task. Furthermore, the sides 54 may include markings 30. The markings 30 may be used to measure distances in inches, centimeters, or the like.

The planar member 22 is of minimal size. In one embodiment, the planar member 22 is about ten inches in length and about one and three-quarter inches in width. The relatively small size facilitates convenient handling and storing of the device 20. The marking device 20 easily fits in a pocket, toolbox or tool belt. Since the marking device 20 is easily transported, a worker is more likely to use the marking device 20. Conventional marking devices do not easily fit in a pocket or tool belt. Consequently, conventional marking devices are not often used.

In addition, the device 20 functions as a wrench for two different sizes of anchor nuts 52. Preferably, the device 20 is an open-end wrench. Typically, the worker secures anchor bolts 14 used with 2×4 inch sill boards 10 with anchor nuts 52 that are ¾-inch size, and anchor bolts 14 used with 2×6 inch sill boards 10 with anchor nuts 52 that are 15/16-inch size. Preferably, the first end 24, used to measure bolt holes for 2×4 inch sill boards 10, is configured as a wrench head 50.

The wrench head 50 is sized to secure a ¾-inch anchor nut 52 on at least two opposing sides. Similarly, the second end 26 is configured as a wrench head 50 sized to accommodate 15/16-inch anchor nuts 52. The bottom surface 38 may include markings 30 indicating which end is to be used with which size nut 52. Alternatively, the top surface 36 may include the markings 30.

Alternatively, the opening 34 for the ends 24, 26 may be configured to properly mark the bolt holes and engage a corresponding anchor nut 52 on more than two sides. For example, in certain embodiments, the arms 32 may close to form a hexagon-shaped wrench head 50 that engages a corresponding anchor nut 52 on all sides. Preferably, the wrench head 50 is sized to provide the structural integrity necessary to allow the worker to apply sufficient torque to the anchor nuts 52 for tightening and loosening as desired.

In yet another embodiment, the wrench head 50 may form a closed opening and the arms 32 may include a ratchet mechanism (not illustrated). The ratchet mechanism allows the device 20 to tighten or loosen the anchor nut 52 when rotated in a first direction and to move freely with respect to the anchor nut 52 when rotated in the opposite direction. Of course various ratchet mechanisms may be integrated into the wrench head 50 of a device 20. For example, the ratchet may comprise a box end ratchet, a conventional socket ratchet, or the like.

Figure 6:
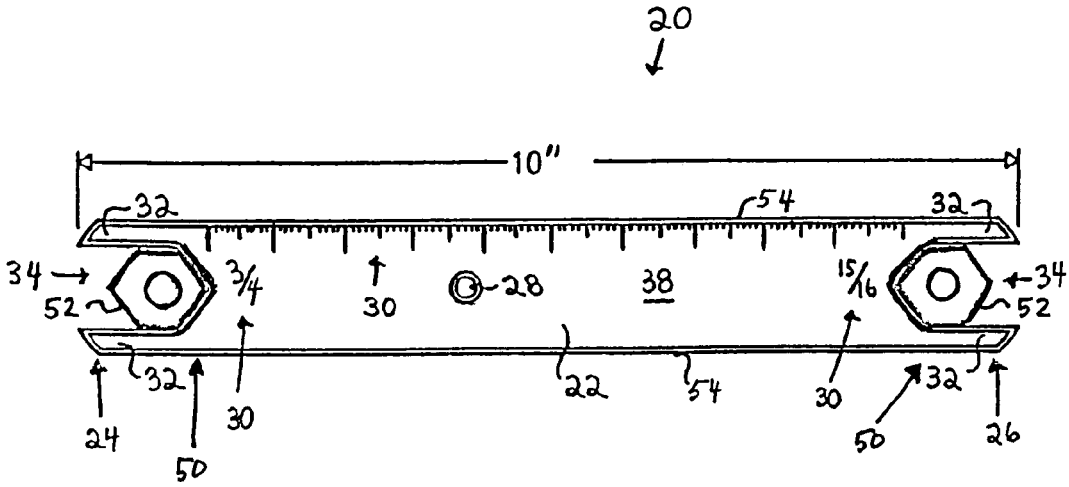
FIG. 6 is a bottom view of an alternate embodiment of a marking device in accordance with the present invention.

FIG. 6 illustrates one embodiment of the present invention in which the opening 34 is substantially "U" shaped and the base of the "U" is "V" shaped to form a hex-shaped wrench head 50 for engaging a hex-shaped anchor nut 52. This allows more torque to be applied to the nut anchor 52 because more sides of the anchor nut 52 are engaged.

Figure 7:
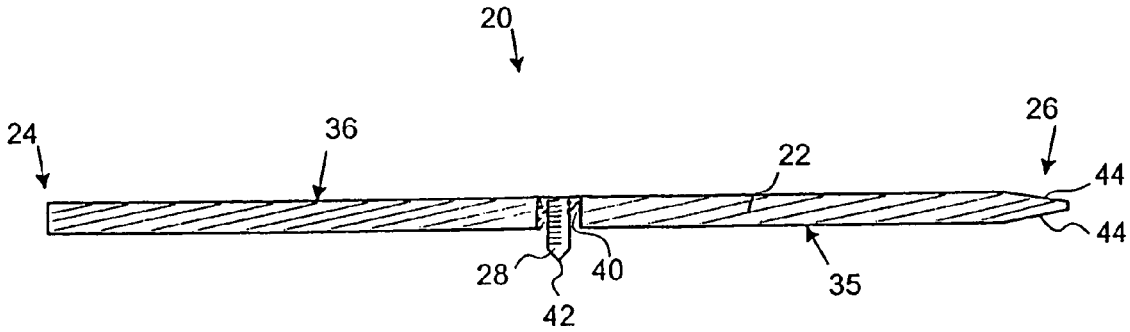
FIG. 7 is a cross-section view of one embodiment of the present invention.

FIG. 7 illustrates a cross-section view of one embodiment of the present invention in which the securing member 40 comprises a cavity that extends through the planar member 22. In one embodiment, the securing member 40 comprises a threaded hole and the punch 28 comprises a threaded screw or bolt having a head (not illustrated) and pointed end. The head may be an Allen head, Phillips head, and may extend above the top surface 36 or sit even with a plane defined by the top surface 36.

The punch 28 may be inserted into the securing member 40 from the top surface 36 or the bottom surface 38. Alternatively, the punch 28 may be embodied as a rivet that extends through the planar member 22. Of course, the punch 28 may also be formed together with the planar member 22. For example, the punch 28 and planar member 22 may be formed by casting or molding fabrication techniques. Alternatively, the punch 28 and planar member 22 may be machined, stamped, or punch pressed.

In an alternative embodiment, the punch 28 is retractable within the planar member 22. For example, the punch 28 may be embodied as a thumb-screw (not illustrated). The thumb-screw may be threaded through the securing member 40 and include a pointed end. The head of the thumb-screw may extend above the top surface 36. The thumb-screw may be sized such that when the thumb-screw is unscrewed, the pointed end is recessed within the cavity, but the thumb-screw remains secured by the securing member 40. To use the device 20, the thumb-screw may be tightened to extend the point end of the punch 28.

Figure 8:
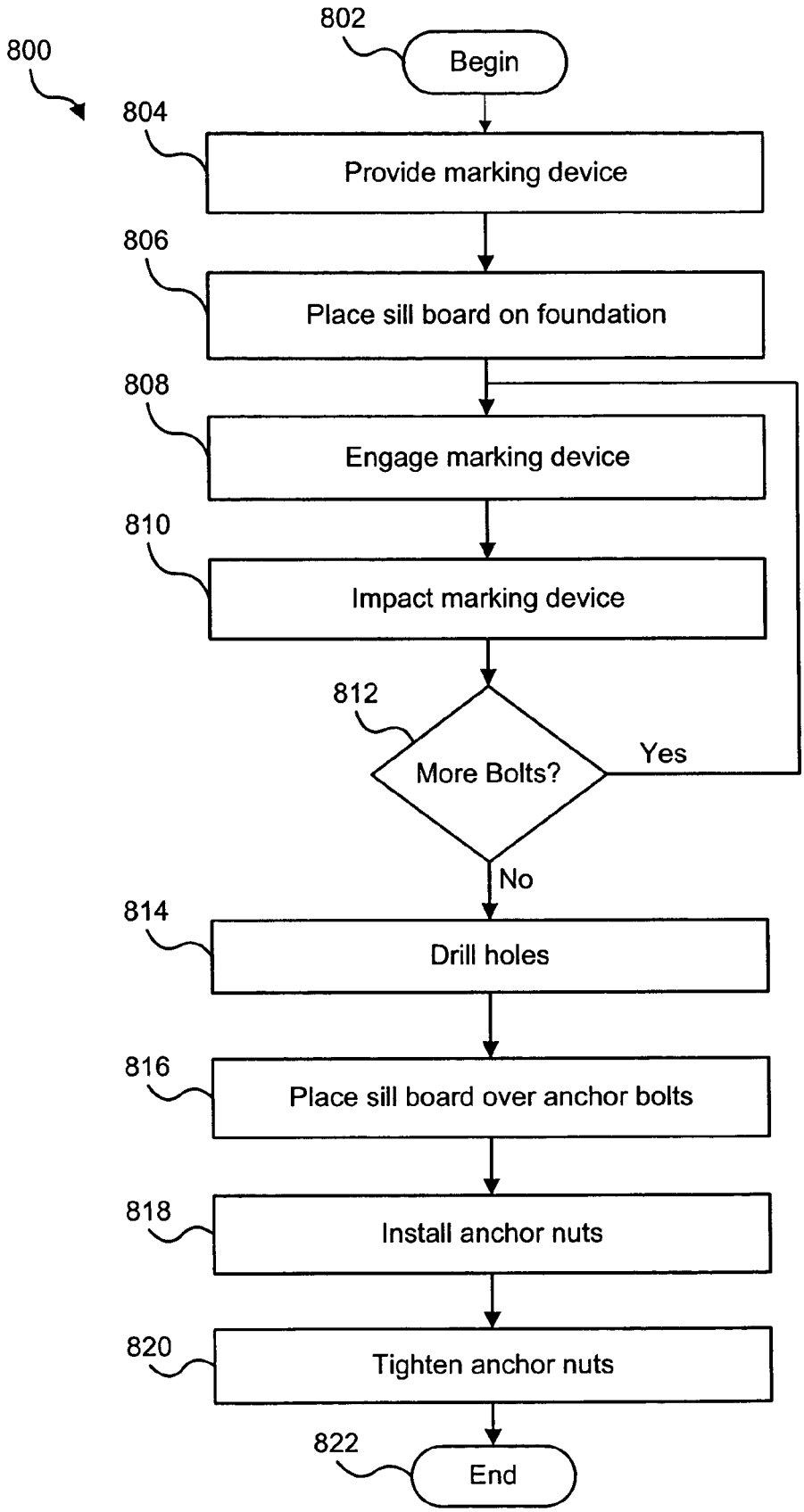
FIG. 8 is a flow chart diagram illustrating one embodiment of a method of the present invention for installing sill boards.

FIG. 8 illustrates a method 800 for using the marking device 20 to mark bolt hole locations on sill boards 10. The method begins 802 when a worker provides 804 the marking device 20. The worker places 806 a sill board 10 on a foundation 12 and aligns the sill board 10 so that it is a predetermined distance from the edge of the foundation 12. The worker may use a chalk line 11 to align the sill board 10 with the edge of the foundation 12.

The worker selects one end 24,26 of the marking device 20 based on the size of the sill board 10 to be marked. Typically, one end 24,26 of the marking device 20 is configured for marking 2×4 sill boards 10 and the other end 24,26 is configured for marking 2×6 sill boards 10. The worker then engages 808 the opening 34 of the selected end 24,36 of the marking device 20 with an anchor bolt 14 such that the marking device 20 is perpendicular to the sill board 10, as illustrated in FIG. 2.

Next, the worker impacts 810 the top surface 36 of the marking device 20 above the punch 28. The impact forces the punch 28 to create a mark in the sill board 10. The worker determines 812 if additional marks are necessary. If so, the worker repeats the process of engaging 808 and impacting 810 for each anchor bolt over which the sill board 10 is to be placed.

Next, the worker drills 814 holes large enough to accommodate the anchor bolts 14 in the sill board 10 at each of the marked locations. The worker then places 816 the sill board 10 over the anchor bolts 14 so that the sill board 10 slides over the bolts 14 and rests on the foundation 12.

Next, the worker installs 818 an anchor nut 52 on each of the anchor bolts 14 by threading them on the bolts 14 so that the nuts 52 are hand-tight. The worker then tightens 820 each anchor nut 52 tight against the sill board 10 with the wrench head 50 of the marking device 20 and the method ends 822.

Figure 9:
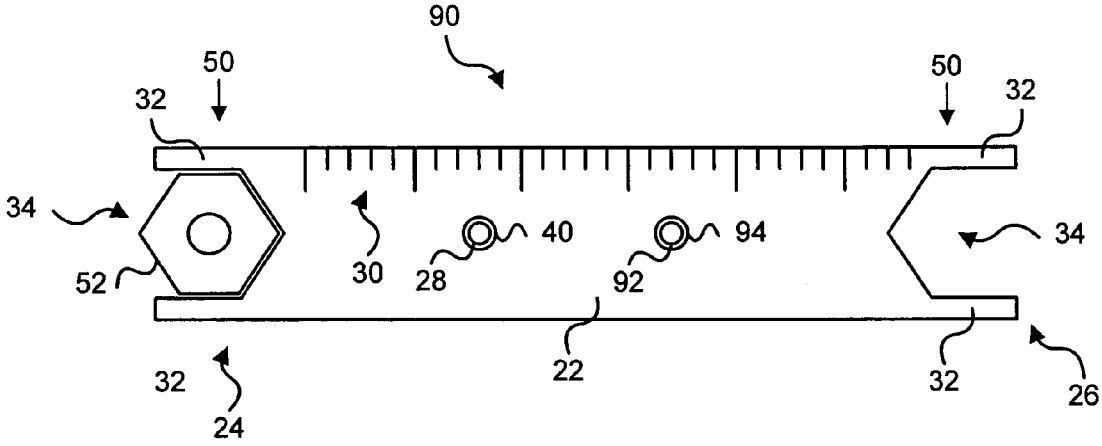
FIG. 9 is a bottom view of one embodiment of a marking device in accordance with the present invention.

FIG. 9 illustrates a bottom view of one embodiment of a marking device 90 designed for use with both 2×4 sill boards 10 and 2×6 sill boards 10. The marking device 90 has one punch 28 aligned with the first end 24 of the marking device 90 and another punch 92 aligned with the second end 26 of the marking device 90. A securing member 94 attaches the second punch 92 to the marking device 90.

The length of the marking device 90 may be chosen so that when marking 2×4 sill boards 10 by engaging an anchor bolt 14 with the first end 24 the second punch 92 does not mark the sill board 10 but the first punch 28 does. Similarly, when marking 2×6 sill boards 10 the second punch 92 marks and the first punch 28 does not. Alternatively, the worker may remove the second punch 92 from the marking device 90 when marking 2×4 sill boards 10. Similarly, the worker may remove the first punch 28 from the marking device 90 when marking 2×6 sill boards 10. Both ends 24,26 of the marking device 90 are configured to function as wrench heads 50. The wrench heads 50 may be used to engage anchor nuts 52.

Figure 10:
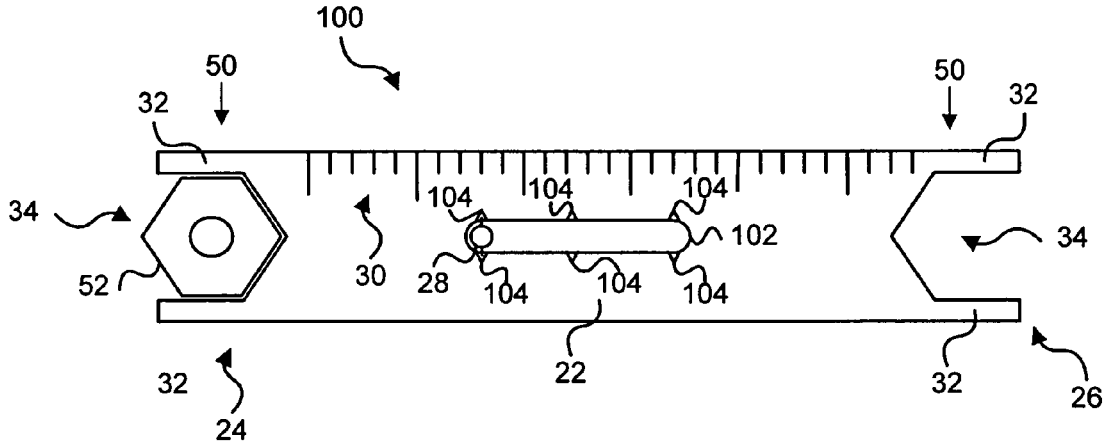
FIG. 10 is a bottom view of one embodiment of a marking device in accordance with the present invention.

FIG. 10 illustrates another embodiment of a marking device 100. The marking device 100 includes a securing member 102 that allows the worker to adjust the punch 28 both horizontally and vertically. The punch 28 is adjusted horizontally by sliding the punch 28 along a slot in the securing member 102 until the punch 28 snaps into a detent 104 of the securing member 102. The securing member 102 may provide several detents 104 each in desirable locations along the planar member. The locations are defined such that the punch 28 operably marks a 2×4 sill board 10 or 2×6 sill board 10. Other methods of allowing for horizontal adjustment of the punch 28 may also be used.

Figure 11:
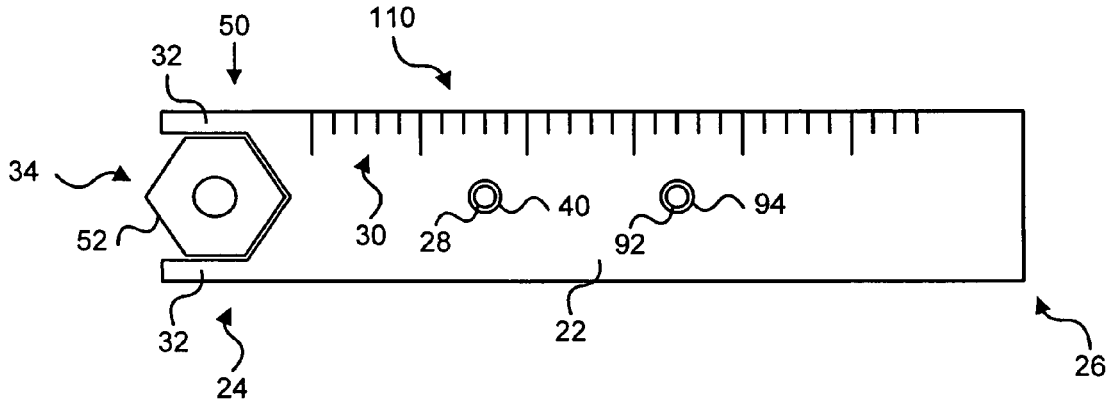
FIG. 11 is a bottom view of one embodiment of a marking device in accordance with the present invention.

FIG. 11 illustrates another embodiment of a marking device 110. The marking device 110 includes a single end 24 configured to receive an anchor bolt 14. The marking device 110 may include two securing members 40,94 that attach two punches 28,92 to the marking device 110. One punch 28 is spaced a predetermined distance from the end 24 for marking 2×4 sill boards 10. The other punch 92 is spaced a second predetermined distance from the first end 24 for marking 2×6 sill boards 10.

The worker may remove the second punch 92 when marking 2×4 sill boards 10 so that the marking device 110 leaves a single mark on the sill board 10 when impacted. Similarly, the worker may remove the first punch 28 when marking 2×6 sill boards 10 so that the marking device 110 leaves a single mark when impacted. Alternatively, either the first punch 28 or second punch 92 may be recessed into the planar member so that the marking device 110 leaves a single mark when impacted.

One embodiment of a marking device may be designed for use with one size of sill board 10. The marking device has one end 24 configured to receive an anchor bolt 14, similar to the marking device 110 illustrated in FIG. 11. However, in this embodiment 110 a single punch 28 is a predetermined distance from the end 24 of the marking device. The predetermined distance is chosen for 2×4 sill boards 10, 2×6 sill boards 10, or sill boards of other dimensions. This embodiment may require the worker to have two marking devices, one for 2×4 sill boards 10 and another for 2×6 sill boards 10.

Figure 12A:
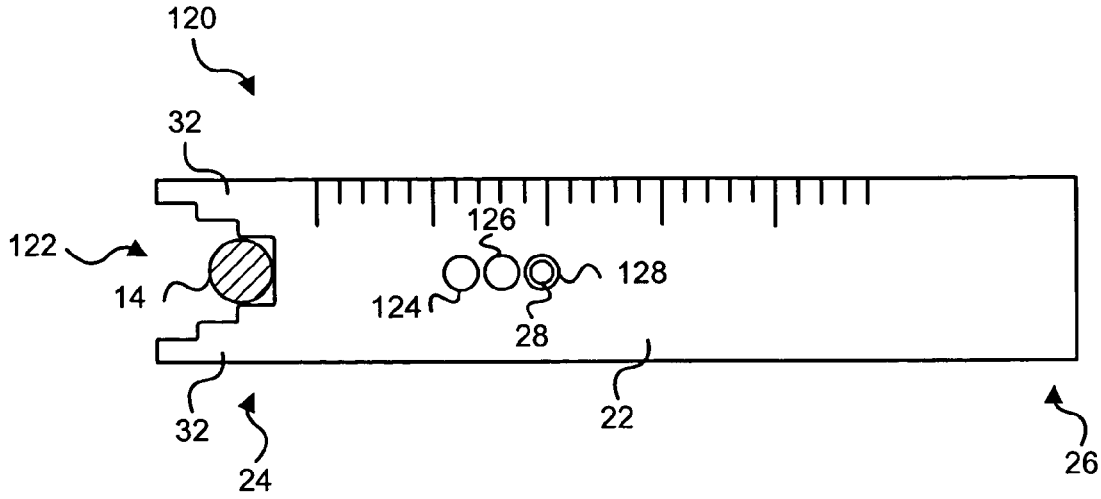
FIG. 12A is a bottom view of one embodiment of a marking device with one end comprising a tortured slot in accordance with the present invention.
Figure 12B:
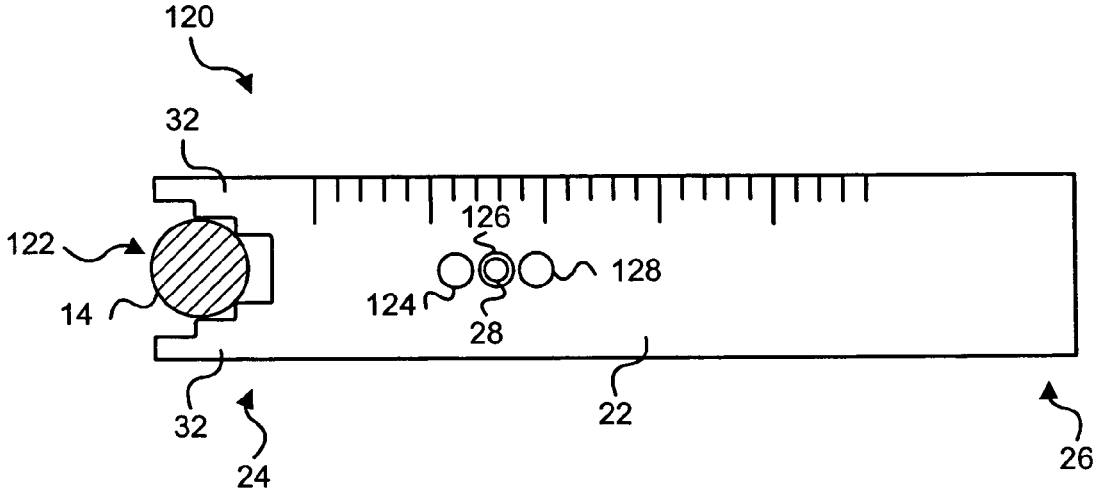
FIG. 12B is a bottom view of one embodiment of a marking device with one end comprising a tortured slot in accordance with the present invention.
Figure 12C:
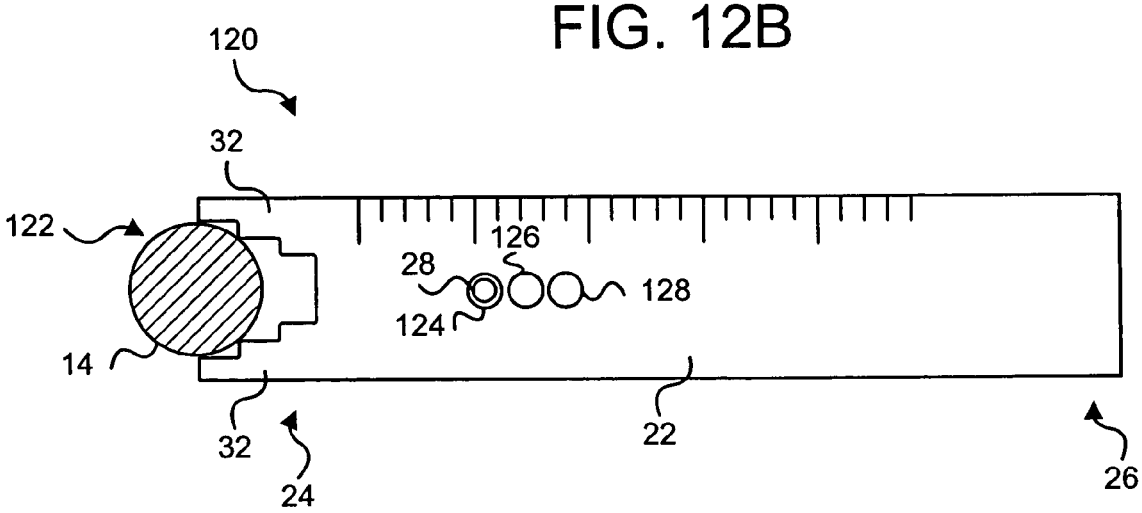
FIG. 12C is a bottom view of one embodiment of a marking device with one end comprising a tortured slot in accordance with the present invention.

FIGS. 12A–C illustrate yet another embodiment of a marking device 120 that includes a tortured slot 122 configured to receive anchor bolts 14 of three different diameters. The tortured slot 122 comprises arms 32 in a stepped configuration providing an inner, middle, and outer position for an anchor bolt 14. FIG. 12A illustrates an anchor bolt 14 of a first diameter in the inner position of the tortured slot 122. FIG. 12B illustrates an anchor bolt 14 of a second diameter in the middle position of the tortured slot 122. FIG. 12C illustrates an anchor bolt 14 of a third diameter in the outer position of the tortured slot 122.

The marking device 120 may include three securing members 124,126,128. One or more securing members 124,126,128 may secure a punch 28 to the marking device 120. When the worker places the marking device 120 such that an anchor bolt is in the innermost position of the tortured slot 122, as depicted in FIG. 12A, the rightmost securing member 128 secures the punch 28 to the marking device 120. The distance from the innermost position of the tortured slot 122 to the rightmost securing member 128 is selected based on the diameter of an anchor bolt 14 that fits in the innermost position of the tortured slot 122 and a particular sill board 10 size (for example a 2×4 sill board 10).

FIG. 12B illustrates a marking device 120 with an anchor bolt 14 in the middle position of the tortured slot 122. The anchor bolt 14 has a larger diameter than the anchor bolt 14 depicted in FIG. 12A. The anchor bolt 14 will not fit in the innermost position of the tortured slot 122 due to its diameter. When the worker places the marking device 120 such that an anchor bolt is in the middle position of the tortured slot 122, as depicted in FIG. 12B, the middle securing member 126 secures the punch 28 to the marking device 120. The distance from the middle position of the tortured slot 122 to the middle securing member 126 is selected based on the diameter of an anchor bolt 14 that fits in the middle position of the tortured slot 122 and a particular sill board 10 size.

FIG. 12C illustrates a marking device 120 with an anchor bolt 14 in the outer position of the tortured slot 122. When the worker places the marking device 120 such that an anchor bolt 14 is in the outer position of the tortured slot 122, as depicted in FIG. 12C, the outer securing member 124 secures the punch 28 to the marking device 120. The distance from the outer position of the tortured slot 122 to the outer securing member 124 is selected based on the diameter of an anchor bolt 14 that fits in the outer position of the tortured slot 122 and a particular sill board 10 size.

Typically, one punch 28 is secured to the marking device 120 by one of the securing members 124,126,128 at a time so that one mark is left on the sill board 10 when the worker impacts the marking device 120. The distances from the tortured slot 122 to the securing members 124,126,128 allow the worker to use the marking device 120 for a sill boards of a particular size (For example 2×4 sill boards 10) and anchor bolts of three different diameters. In this case, the worker may have more than one marking device 120, each with distances suitable for a particular sill board 10 size. (For example one marking device 120 for 2×4 sill boards 10 and another marking device 120 for 2×6 sill boards 10)

Alternatively, the distances from the tortured slot 122 to the securing members 124,126,128 allow the worker to use a single marking device 120 for three different sill board 10 sizes. For example, the inner position may be configured for 2×4 sill boards 10, the middle position for 2×6 sill boards 10, and the outer position for 2×8 sill boards 10. In this case anchor bolts 14 with a first diameter are used for 2×4 sill boards 10, anchor bolts 14 with a second diameter are used for 2×6 sill boards 10, and anchor bolts 14 with a third diameter are used for 2×8 sill boards 10.

Referring now to FIGS. 1–12 collectively, the present invention provides a small multi-purpose marking device 20 for measuring and marking bolt holes for two different sizes of sill boards, 2×4 inches and 2×6 inches. In addition, another tool may be integrated with the planar member of the marking device. For example, the present invention provides a wrench head for fastening two different size anchor nuts 52 to the anchor bolts 14. Furthermore, the present invention may provide a pry-bar, straight edge, and ruler function. Consequently, a worker may simply carry the present invention without carrying a separate marking device, measuring device, straight edge, ruler, pry bar, and/or two different size wrenches. Using the present invention, a worker may accurately and quickly mark a plurality of anchor bolts 14 for sill boards 10 of different sizes. Finally, the present invention is lightweight, sturdy, durable, simple, and inexpensive to fabricate.

While specific embodiments and applications of the present invention have been illustrated and described, it is to be understood that the invention is not limited to the precise configuration and components disclosed herein. Various modifications, changes, and variations apparent to those skilled in the art may be made in the arrangement, operation, and details of the methods and systems of the present invention disclosed herein without departing from the spirit and scope of the invention. The scope of the invention is, therefore, indicated by the appended claims rather than by the foregoing description. All changes which come within the meaning and range of equivalency of the claims are to be embraced within their scope.

What is claimed is:

1. A substantially planar marking device, comprising:

a substantially planar member having a first end and a second end, the ends configured to receive an anchor bolt; and a first punch positioned a first distance between the ends such that the punch is aligned with each end, the punch configured to continuously extend a predetermined distance from a face of the planar member during operation of the marking device;

wherein the ends are configured to engage an anchor nut and serve as a wrench head for adjusting the anchor nut relative to the anchor bolt.

2. The marking device of claim 1, further comprising a second punch positioned a second distance between the ends such that the second punch is aligned with each end.

3. The marking device of claim 1, wherein the punch extends perpendicular to the face of the planar member.

4. The marking device of claim 1, wherein the position of the punch is fixed relative to the planar member.

5. The marking device of claim 1, wherein the punch is connected to the planar member by a securing member, the securing member configured such that the punch can be adjusted laterally with respect to the planar member.

6. The marking device of claim 1, further comprising at least one tool integrated with the planar member.

7. A substantially planar marking device, comprising:

a rectangular, substantially planar member having an end configured to receive an anchor bolt; and a first punch positioned a first distance from the end and aligned with the end, the punch configured to continuously extend a predetermined distance from a face of the planar member during operation of the marking device;

wherein the end is configured to engage an anchor nut and serve as a wrench head for adjusting the anchor nut relative to the anchor bolt.

8. The marking device of claim 7, further comprising a second punch positioned a second distance from the end such that the second punch is aligned with the end.

9. The marking device of claim 7, wherein the punch extends perpendicular to the face of the planar member.

10. The marking device of claim 7, wherein the position of the punch is fixed relative to the planar member.

11. The marking device of claim 7, wherein the punch is connected to the planar member by a securing member, the securing member configured such that the punch can be adjusted laterally with respect to the planar member.

12. A substantially planar marking device, comprising:

a rectangular, substantially planar member having an end configured to receive an anchor bolt; and a first punch positioned a first distance from the end and aligned with the end, the punch configured to continuously extend a predetermined distance from a face of the planar member during operation of the marking device;

wherein the end comprises a tortured slot configured to receive anchor bolts having a plurality of diameters.

13. A method of marking anchor bolt holes on a sill board, the method comprising:

providing a substantially planar marking device, having;

a substantially planar member having a first end and a second end, the ends configured to receive an anchor bolt; and a first punch positioned a first distance between the ends such that the punch is aligned with one end of the marking device, the first punch configured to continuously extend a predetermined distance from a face of the planar member while the method is being carried out;

placing a sill board on a foundation a predetermined offset from an edge of the foundation;

engaging the anchor bolt with one end of the marking device such that the marking device is perpendicular to the sill board; and impacting a surface of the marking device such that the punch marks the sill board;

wherein the punch is connected to the planar member by a securing member, the securing member configured such that the punch can be adjusted laterally with respect to the planar member;

wherein the punch extends perpendicular to the face of the planar member;

wherein the position of the punch of the marking device is fixed relative to the planar member; and wherein the ends of the marking device are configured to engage an anchor nut and serve as a wrench head for adjusting the anchor nut relative to the anchor bolt.

14. The method of claim 13, further comprising:

drilling holes in the sill board at locations marked by the punch;

placing the sill board over the anchor bolts;

installing anchor nuts over the anchor bolts; and tightening the anchor nuts with the wrench head of one end of the planar member.

15. A substantially planar marking device, comprising:

a substantially planar member having a first end and a second end, the ends configured to receive an anchor bolt; and a first punch positioned a first distance between the ends such that the punch is aligned with each end, the punch configured to continuously extend a predetermined distance from a face of the planar member during operation of the marking device;

wherein each end comprises a tortured slot configured to receive anchor bolts having a plurality of diameters.

16. The marking device of claim 7, further comprising at least one tool integrated with the planar member.

* * * * *